US010962248B1

(12) United States Patent
Hasan et al.

(10) Patent No.: US 10,962,248 B1
(45) Date of Patent: Mar. 30, 2021

(54) METHOD OF AUTO ASSOCIATION OF HVAC ENERGY WITH CONTROL SIGNAL FOR SELF DIAGNOSTICS OF THE HVAC SYSTEM

(71) Applicant: EnTouch Controls Inc., Richardson, TX (US)

(72) Inventors: Iftekhar Hasan, Richardson, TX (US); Gregory H. Fasullo, Dallas, TX (US); Frank I. Menocal, Plano, TX (US)

(73) Assignee: EnTouch Controls Inc., Richardson, TX (US)

( * ) Notice: Subject to any disclaimer, the term of this patent is extended or adjusted under 35 U.S.C. 154(b) by 640 days.

(21) Appl. No.: 14/331,978

(22) Filed: Jul. 15, 2014

Related U.S. Application Data

(60) Provisional application No. 61/846,469, filed on Jul. 15, 2013.

(51) Int. Cl.
*F24F 11/30* (2018.01)

(52) U.S. Cl.
CPC ..... *F24F 11/30* (2018.01)

(58) Field of Classification Search
CPC ..... F24F 11/0009; G06Q 50/06; H02J 11/00; H02J 3/14; G01D 4/004; G05B 15/02
See application file for complete search history.

(56) References Cited

U.S. PATENT DOCUMENTS

2010/0145542 A1* 6/2010 Chapel ..... H02J 13/00034 700/295
2011/0046790 A1* 2/2011 Miller ..... G05B 19/042 700/276
2011/0101956 A1* 5/2011 Thorn ..... G01D 4/004 324/76.11
2011/0202293 A1* 8/2011 Kobraei ..... G06Q 50/06 702/62
2012/0197453 A1* 8/2012 Pugh ..... G05B 15/02 700/293
2012/0323510 A1* 12/2012 Bell ..... H02J 3/14 702/62
2013/0297076 A1* 11/2013 Davis ..... H02J 11/00 700/276
2016/0370771 A1* 12/2016 Torres Fuchslocher ..... G06Q 50/06

* cited by examiner

*Primary Examiner* — Nathan L Laughlin
(74) *Attorney, Agent, or Firm* — Frost Brown Todd LLC

(57) ABSTRACT

A system and method are described for self-diagnosing heating, ventilation and air conditioning (HVAC) systems. The system and method correlate an HVAC control mode of a particular HVAC unit with an energy usage for the particular HVAC unit in order to match normal patterns in energy usage with the HVAC control mode. This correlation allows the system and method to identify potential problems with the particular HVAC unit based on deviations from normal patterns.

14 Claims, 7 Drawing Sheets

METHOD OF AUTO ASSOCIATION OF HVAC ENERGY WITH CONTROL SIGNAL FOR SELF DIAGNOSTICS OF THE HVAC SYSTEM

CROSS REFERENCE TO RELATED INFORMATION

This application claims the benefit of U.S. Provisional Patent Application No. 61/846,469, filed Jul. 15, 2013, filed, "Method of Auto Association of HVAC Energy with Control Signal for Self Diagnostics of the HVAC System", the contents of which are hereby incorporated herein in its entirety.

TECHNICAL FIELD

The present disclosure is directed to heating, ventilation and air conditioning systems (HVAC), and more particularly to using system control states, data, and energy usage to detect existing and upcoming problems and failures in the system.

BACKGROUND OF THE INVENTION

Traditional thermostats monitor the temperature at location inside a building and turn either a heating system or an air conditioning system in response to changes in the monitored air temperature. More recently, programmable thermostats have allowed the owner or manager of a building to adjust the temperature set point by day or week and time of day, allowing more control over HVAC systems and reduced energy consumption from changing the set point when the building is vacant or unused. New intelligent thermostats are now entering the market that allow for remote access and control. A significant variation in these remote accessible thermostats is available in the market, which are solely dedicated to control and access of HVAC system.

In addition to intelligent thermostats, many standalone metering and sub metering devices are available to measure energy at different load point and report it to the users. These meters are all configured and scale the data at the point of measurement so that they can measure individual load. For example, if a 3-phase load is to be metered, the prior art would require this to be field configured as such with proper hardware setup. Also, in the event multiple load point is measured, they remain isolated measurements. In some cases, these types of measurements are sufficient to provide the useful information, however, the data is limited to overall usage or the usage of specific loads without any ability to group or characterize the loads.

While energy monitoring is becoming more common, no one has combined the energy usage monitoring for HVAC loads with control steps. Combining HVAC control with electrical energy usage data gathering for any targeted load in the building allows the association of the HVAC control mode (idle, cool, heat, fan etc.) with the energy pattern of the corresponding HVAC. This correlation can be very useful and can be utilized to trend and pattern match, which can reveal any exception in the equipment behavior leading to proactive maintenance alerts when combined with other measured variables such as supply air temperature, to pin point exact failure mechanism such as a broken fan belt or a frozen compressor unit.

BRIEF SUMMARY OF THE INVENTION

In a preferred embodiment, a method is described for self-diagnosing heating, ventilation and air conditioning (HVAC) systems. The method correlates an HVAC control mode of a particular HVAC unit with an energy usage for the particular HVAC unit in order to match normal patterns in energy usage with the HVAC control mode. This correlation allows the method to identify potential problems with the particular HVAC unit based on deviations from normal patterns.

In another preferred embodiment, a system for self-diagnosing heating, ventilation and air conditioning (HVAC) systems is described that includes a microcontroller having an HVAC control module communicatively coupled to the microcontroller and operable to provide control signals to an HVAC unit. An energy usage collection interface communicatively coupled to the microcontroller, the energy usage collection interface operable to receive energy usage data from an energy meter installed at an electrical distribution panel. The microcontroller is then operable to correlate an HVAC control mode from the HVAC control module with an energy usage for the HVAC unit, and to match normal patterns in energy usage with the HVAC control mode thereby allowing the system to identify potential problems with the HVAC unit based on deviations from normal patterns.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

As stated, the correlation between control mode and energy pattern can be very useful and can be utilized to trend and pattern match, which can reveal any exception in the equipment behavior leading to proactive maintenance alerts. Even more can be learned when the control state/energy correlation is combined with other measured variables such as supply air temperature, to pin point exact failure mechanism such as a broken fan belt or a frozen compressor unit.

Figure 1:
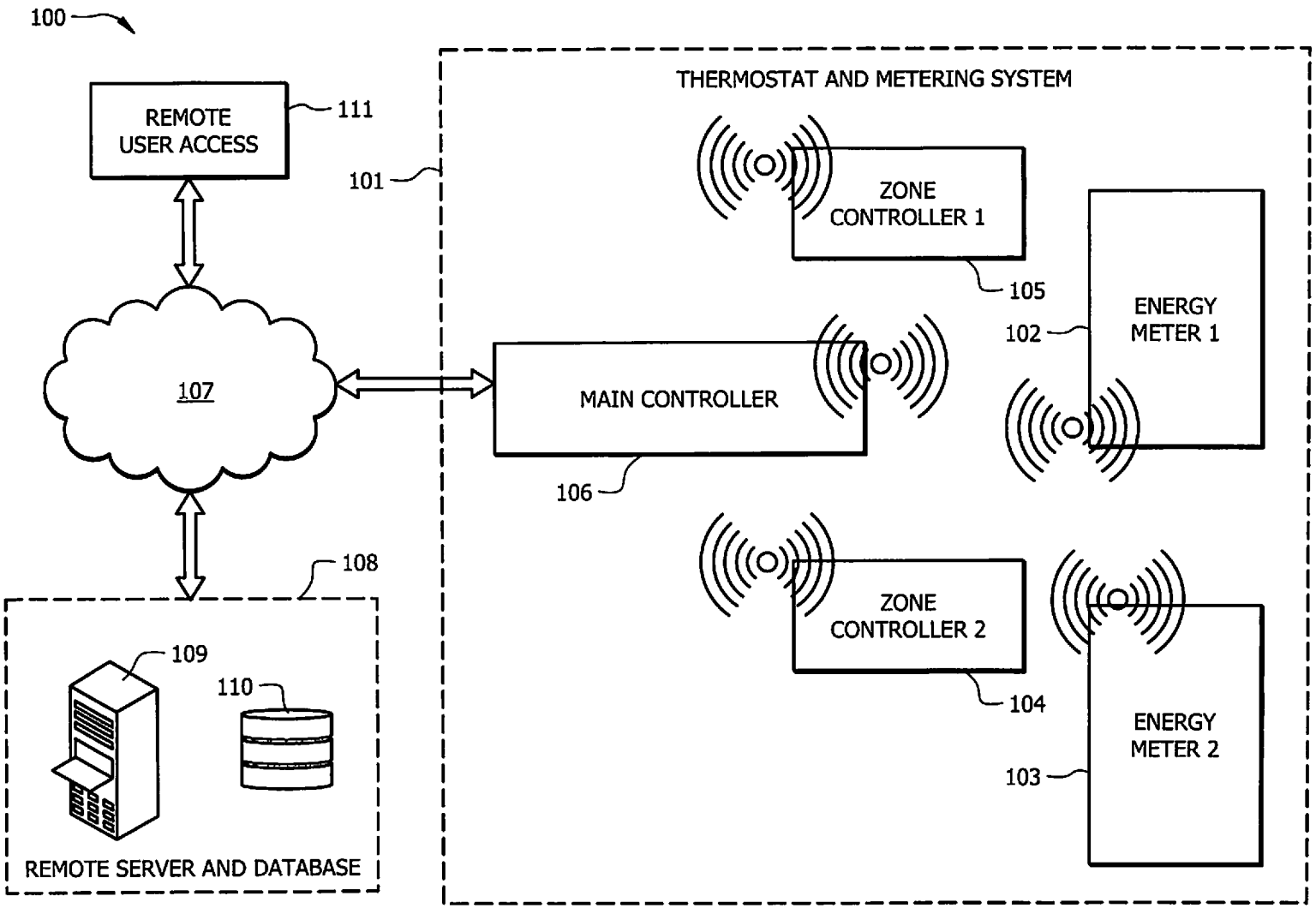
FIG. 1 is a block diagram of a preferred embodiment of an energy monitoring and metering system utilizing an intelligent thermostat in accordance with the concepts described herein.

Referring now to FIG. 1, a preferred embodiment of a basic monitoring and reporting system according to the concepts described herein is shown. System 100 acts both to control the HVAC system in premises 101 and to monitor, meter, analyze and report on the energy usage at premises 101. Energy meters 102 and 103 are installed preferably at a main breaker panel, but can also be installed in sub-panels and distribution panels.

The energy meters 102 and 103 record raw measurements of electrical usage and transmit that data to a main controller 106, which can be either a zone controller, such as zone controller 104 or zone controller 105 or to a main controller 106. In preferred embodiments, the energy meters use current transformers (CTs) to measure the current in the monitored lines. The current is preferably measured on the main electrical inputs to the breaker panel and on all or any selected branch or load lines leaving the panel. The reported energy usage from energy meter 102 and 103 includes the energy usage by HVAC system controlled by main controller 106 and zone controllers 104 and 105. The association of individual main 106 and zone controllers 104 and 105 control status and corresponding energy usage signature is accomplished at remote server 109 and data base as described later.

As described, energy meters 102 and 103 send the collected data to a thermostat/controller. While the data can be sent using hard wired connection without departing from the scope of the invention described herein, in preferred embodiments wireless protocols are used to transmit the data, eliminating the need to run wires between devices or use other forms of wired communications. Any appropriate wireless protocol may be used, including WiFi, Zigby, Bluetooth, cellular, SMS or other wireless protocol that has the appropriate specifications. In a house or building that is small enough for a single thermostat, a single controller, such as the main controller, can be used without losing any functionality. In larger buildings, however, multiple zones may be used to provide better control over the HVAC system. In buildings using multiple zones, each zone can be equipped with its own intelligent controller, shown here as zone controller 104 and zone controller 105, according to the concepts described herein. Each of those zone controllers can then be programmed to report to a main controller 106, which serves as a primary collection and communication hub to communicate with external server 109 and database 110 of system 100.

Main controller 106 communicates with a remote monitoring center 108 that houses an external server 109 and database 110 using network 107, which can be the Internet or any combination of private or public networks. The system may also include more than one remote monitoring center without departing from the scope of the concepts described herein. Remote monitoring center 108 is operable to collect, analyze, and provide access to the information received from main controller and to allow the reprogramming of any or all of the main controller or zone controllers at building 101. Database 110 is used to store both the raw data from the building controllers as well as any process data, configuration information, or other information relevant to the system. External server 109 is used to process the data and to provide a portal for remote access into the data or an access point to remote control the building controllers.

Remote user access 111 allows owners or managers of premises 101 to access and analyze the data collected from premises 101 using external server 109 and database 110. Users can look at past data, real time data, reports and analyses generated from the data and can also adjust operating parameters of the controllers and the system configurations such as scaling factors used to interpret the data collected by the energy meter 102 and 103. Remote monitoring center 108 can be in contact with any number of premises and remote user access 111 can access data and update operating configurations for any number of premises under the user's control.

Figure 2:
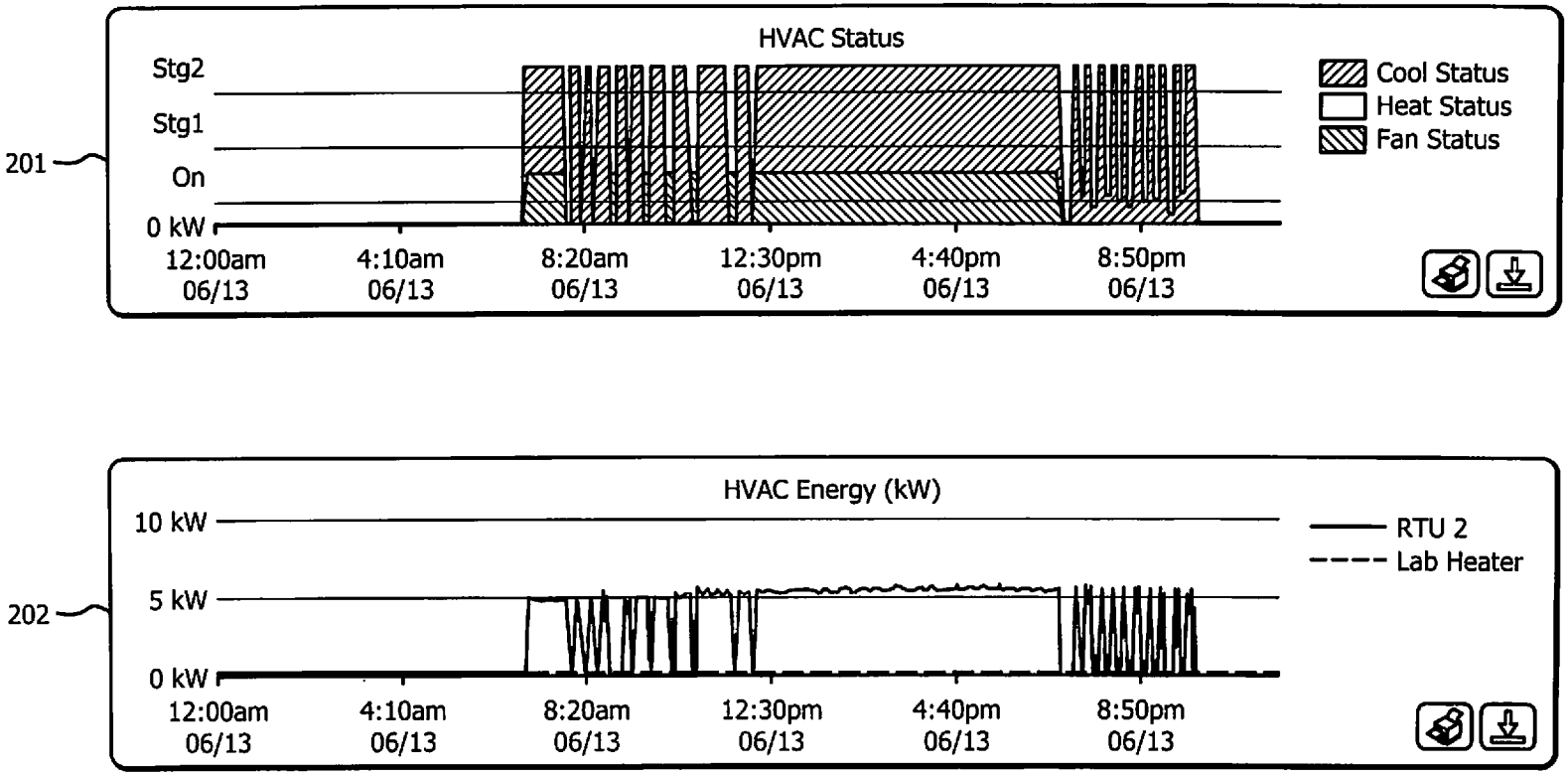
FIG. 2 is a set of graphs showing an example of a correlation between control state and energy usage.

Referring now to FIG. 2, an example of a correlation between HVAC signaling and energy usage is shown and described. An energy management system, according to the concepts described herein, combines HVAC control with electrical energy usage data gathering for any targeted load in the building. The association of the HVAC control mode (idle, cool, heat, fan etc.) and the energy pattern of the corresponding HVAC is a very useful correlation that can be utilized to trend and pattern match, which can reveal any exception in the equipment behavior leading to proactive maintenance alerts when combined with other measured variables such as supply air temperature, to pin point exact failure mechanism such as a broken fan belt or a frozen compressor unit.

During the configuration of the system, one of the challenges is to make sure the control signal and the energy from the HVAC are properly matched. This work is difficult due to poorly marked electrical panels and in buildings with large number of HVAC units. In a managed building, the number of monitored loads and controlled HVAC units can be significantly high which results in difficulty when finding a match between the control and energy monitoring. It is desirable that the correlation is established from data pattern matching. Such a correlation is shown with reference to FIG. 2. FIG. 2 shows the state of an HVAC control signal in graph 201. The signal, in the example of FIG. 2 is a signal for fan and cool. The corresponding HVAC energy usage, shown in graph 202, correlates well to the Fan/Cool signal in graph 201, probably establishing a pattern match according to the concepts described herein.

Figure 3:
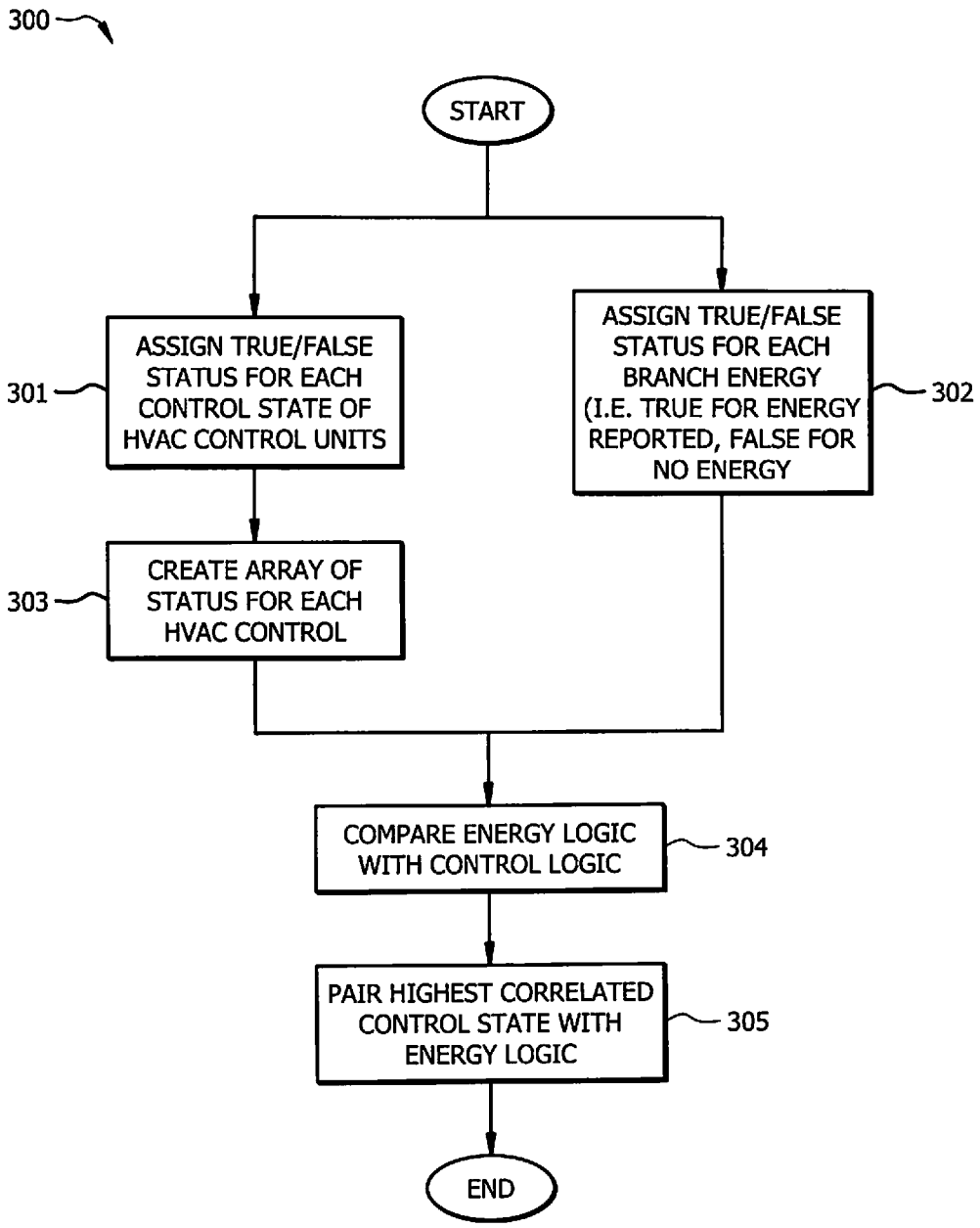
FIG. 3 is a flowchart of a preferred embodiment of a method of correlating control state with energy usage.

Accordingly the present invention provides for a method and approach whereby data is collected to establish the relationship of an HVAC unit with its energy data by pattern matching the control signal for the said HVAC unit. Further, another method, an embodiment of which is shown in FIG. 3, establishes a reference correlation factor of the energy usage with respect to various control stages. Identifying a deviation from the established correlation factor provides for proactive health monitoring of the HVAC unit. The correlation can be extended with other measured variables to perform a detailed remote diagnosis of the HVAC unit failure.

In a preferred embodiment of such a method 300, the steps to auto assign the energy data to the respective HVAC unit can include the following actions.

In time domain, collect control status from each HVAC control unit for a given period (e.g. 24 hours).

Assign a TRUE or FALSE status for each control state of the HVAC control units. The example of controls status are: (i) Cool: Idle, Stage1, Stage2, Stage3; (ii) Heat: Idle, Stage 1, Stage 2, Stage3; or (iii) Fan: Idle, On, shown in block 301;

Assign a TRUE (when any energy is reported) or FALSE (when no energy is reported) for each branch energy (Energy Logic), shown in block 302;

Logically OR the state of the control signal and create a time domain array of TRUE or FALSE for each HVAC control (Control Logic), shown in block 303;

Compare the Energy Logic of each branch of energy with all of the Control Logic, shown in block 304; and The highest correlated HVAC control and energy logic unit are paired with each other shown in block 305.

Once the HVAC control unit and corresponding energy data is properly matched, it is possible to establish more specific reference data for trending and self diagnostics. The energy usage threshold for different states of control can be trended for an extended period of time e.g. 30 days. For example, when FAN state is ON, we record a nominal 1 KW of energy usage. When both FAN and STAGE1 COOL is active, we record a nominal 10 KW of energy usage. From this trending, a nominal threshold of energy can be established for future reference and a range of normal operating deviation from these references can be defined. From the example above, if the reported energy with both FAN and STAGE1 COOL active is 1 KW, it is logical to assume that STAGE 1 compressor is not activating. In other cases, this energy may be fluctuating between 7 KW and 10 KW, indicating a loose or wearing coupling mechanism. Examples of such relationships are shown in FIG. 3.

Figure 4A:
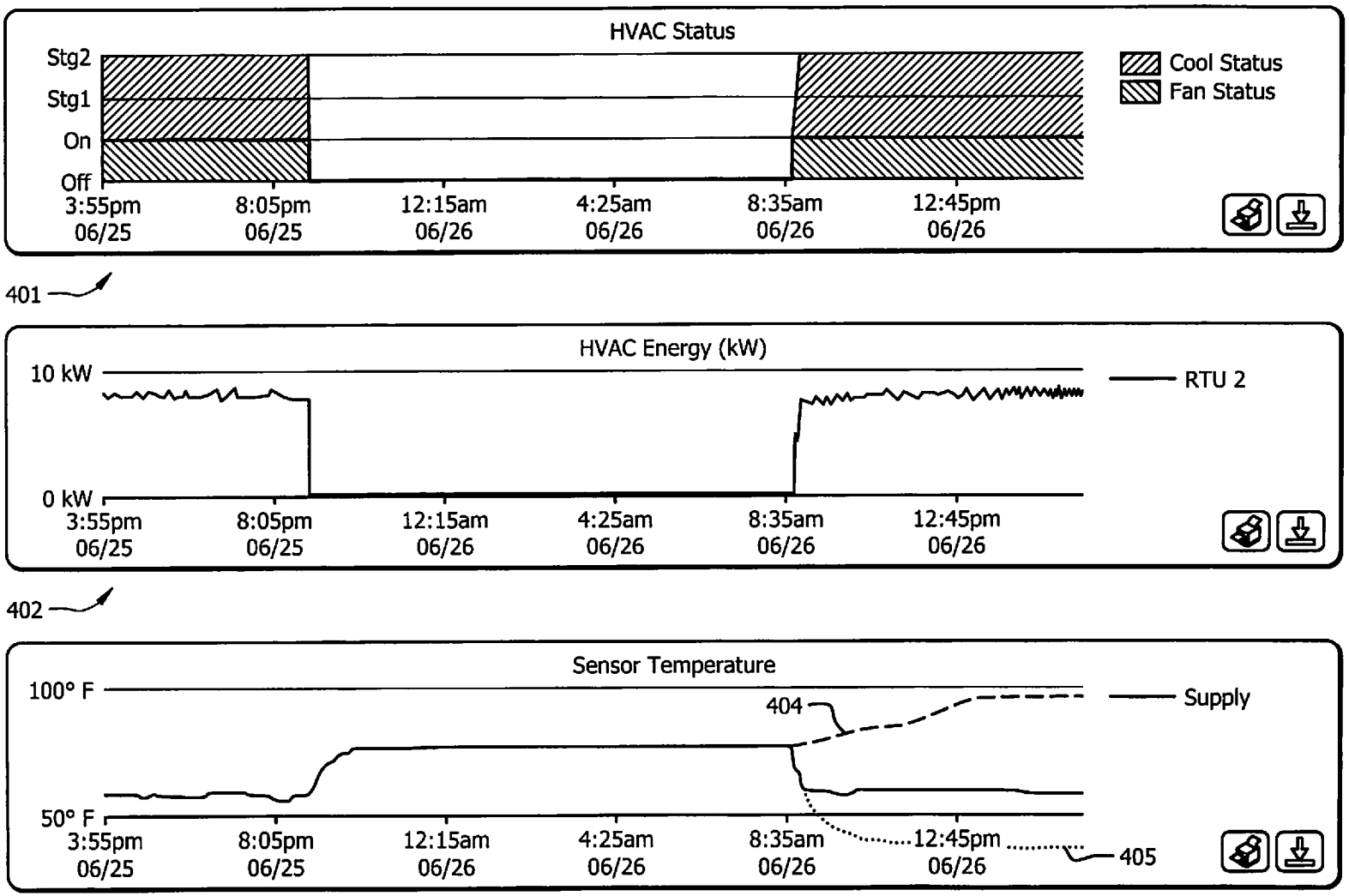
FIGS. 4*a*, 4*b*, and 4*c* are a set of graphs showing examples of a correlation between control state, and energy usage in a system failure, including using another system state (such as sensor temperature)

Additional trouble shooting of a failed system is possible by combining the energy and control signal information with a real time reading of another parameter (e.g. supply air temperature). Referring now to FIG. 4*a*, an example of system trouble shooting using the concepts described herein is shown. If the control and energy correlation is deemed normal, as shown by graphs 401 and 402, but the expected outcome (heating or cooling) is not matching, shown by graph 403, the correlated data trend can proactively detect a failure like low Freon in the system or a clogged filter. In the first case, 404, the supply air will not cool while control and energy pattern may not show a difference. In the event of a frozen compressor, or clogged filter 405, the lack of air movement will cause the sense temperature to drop close to freezing point. Since this type of breakdown is usually gradual, an early trend in either direction can be used as a preventive measure.

Figure 4B:
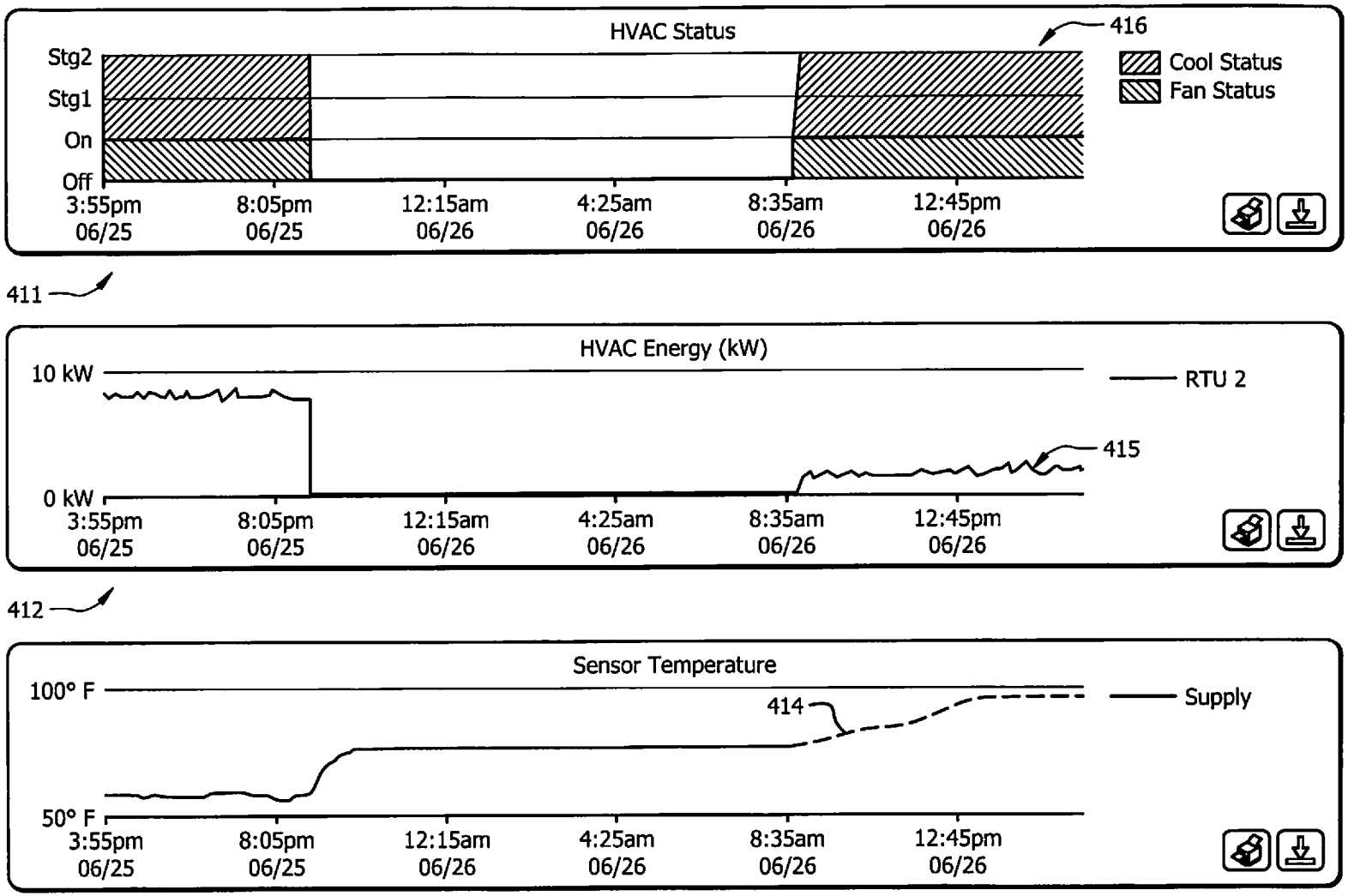

FIG. 4*b* shows an example of a mismatch between control status 411 and energy usage signature 412. Control signal 416 indicates that the HVAC control is calling for cooling, however, the low energy usage 415 indicates that the HVAC system is faulty. This could be caused by a failed contactor, broken belt in the HVAC unit, or other similar cause. The rising temperature sensor 414 in air temperature graph 413 confirms the inadequacy of the HVAC system.

Figure 4C:
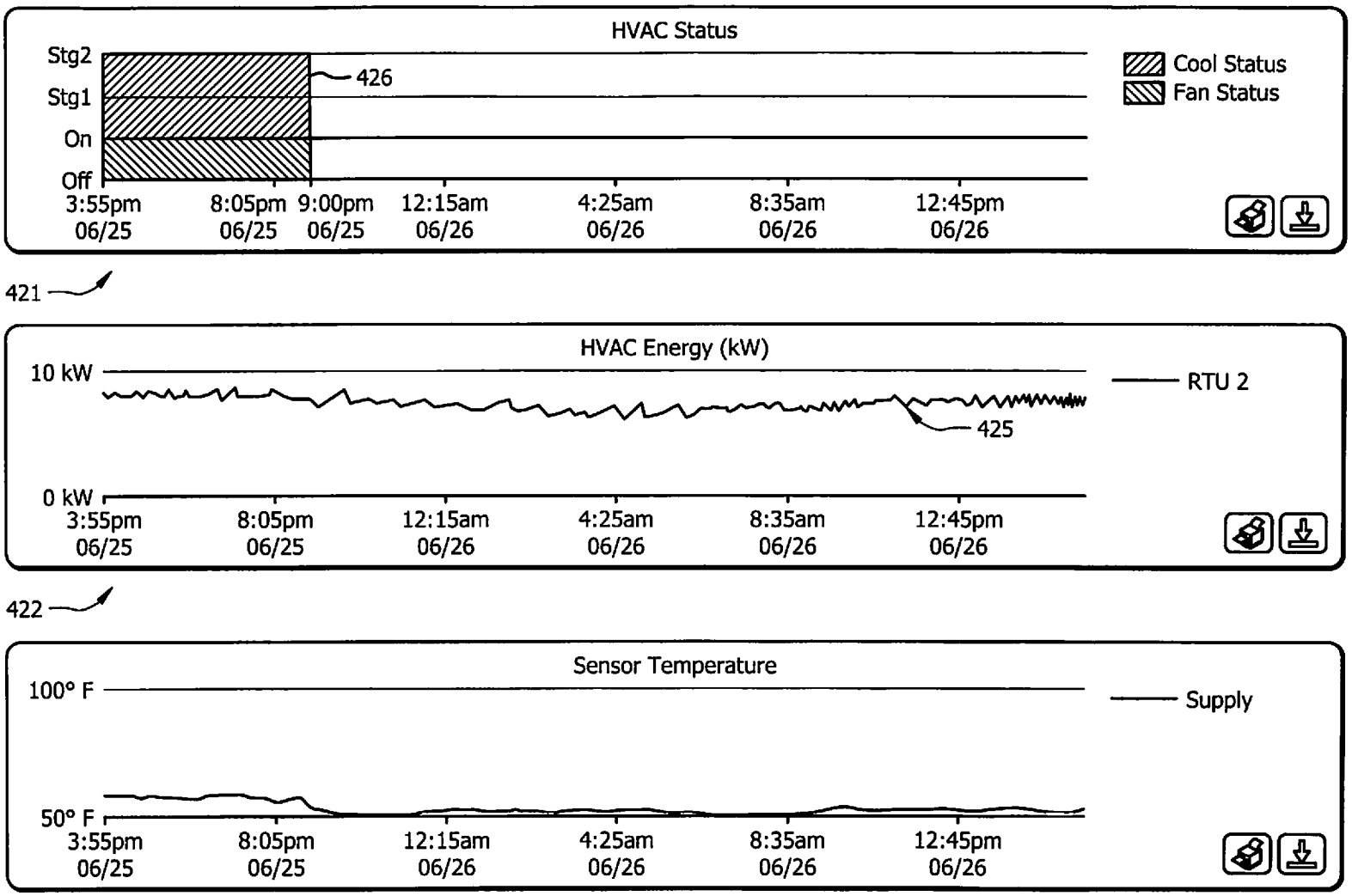

FIG. 4*c* shows another example of system failure indicated by the correlations described herein. HVAC control signal 426 in control signal graph 421 indicates that the cooling need is complete at approximately 9:00 pm and the signal call is to terminate cooling. The energy signature 425 in energy control graph 422 shows that the energy usage by the HVAC system continues at the same level despite the change in control state. This could indicate a faulty contactor in the HVAC system. The continuing drop in air temperature shown in air temperature graph 423 confirms a problem.

Figure 5:
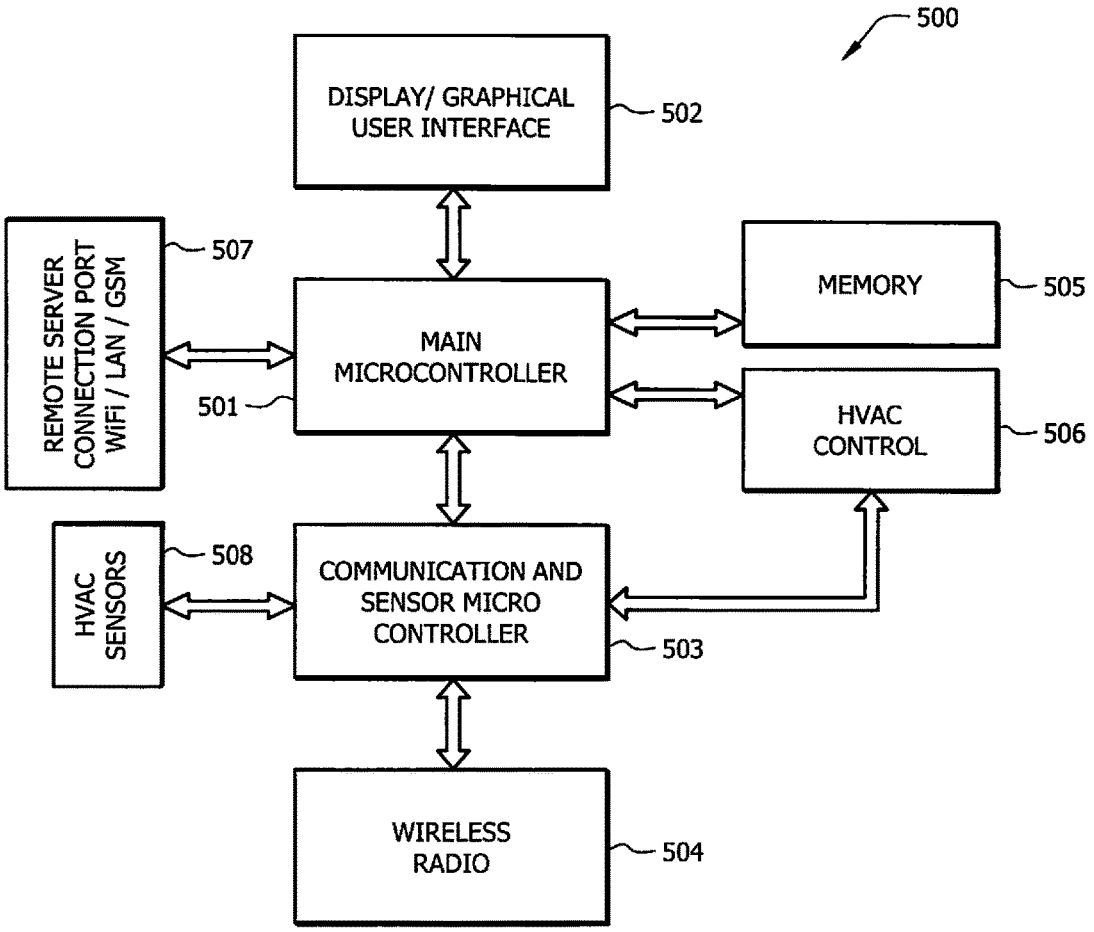
FIG. 5 is a block diagram of a preferred embodiment of a controller as shown in FIG. 1.

Referring now to FIG. 5, an embodiment of a controller, such as main controller 106 or zone controllers 104 or 105 is shown. Controller 500 includes main microcontroller 501, which is operable to execute the programming of controller 500. Main microcontroller 501 may include on board memory to store configuration and programming information or may use some portion of memory 105. Main microcontroller 501 controls the display and graphical user interface 502, through which users may directly interact with the controller to view current status or to change the programming or configuration information. Main microcontroller 501 also controls the remote access port 507, which provides for communications with external networks such as WiFi, LAN, or GSM networks.

Communication and sensor microcontroller 503 is also in communication with main microcontroller 501 and provides the interface between the main microcontroller 501 and any remote HVAC sensors 508. Communication and sensor microcontroller 503 also interfaces with the wireless radio 504, which communicates with the energy meters in the distribution or breaker panel. Communication and sensor microcontroller 503 and main microcontroller 501 also interface with the HVAC controller 506, which is used to control the HVAC system hardware. As shown in FIG. 1, the controller 500 can also communicate with a remote server or user access interface. Using these communication paths, the controller can report identified problems to a data collection system or a designated user for the system.

Figure 6:
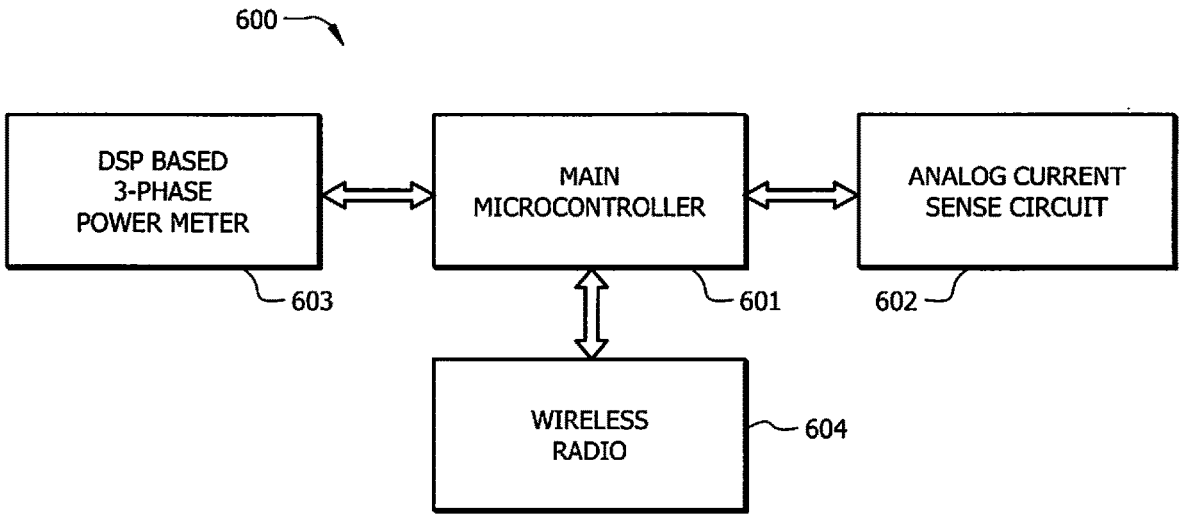
FIG. 6 is a block diagram of a preferred embodiment of an energy meter as shown in FIG. 1.

Referring now to FIG. 6, an embodiment of an energy meter according to the concepts described herein is shown. Energy meter 600 includes microcontroller 601 which acts to execute the programming of energy meter 600. Microcontroller 601 receives inputs from 3-phase power meter 603 and current sense circuitry 602. The DSP based 3-phase power meter 603 measures the power usage at the main 3-phase power inputs to the breaker panel and reports that information to the microcontroller 601. Current sense circuitry 602 is connected to current transformers on any or all of the branch load circuits fed by the breaker panel and measures the current draw of those loads. The loads can be any type of load, such as single phase, 3-phase, etc. The load data is also reported to the microcontroller 601. Microcontroller 601 then reports the collected data in a raw, un-scaled format to a main controller or zone controller over wireless radio 604.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for self-diagnosing heating, ventilation and air conditioning (HVAC) systems comprising:

receiving historical control mode data for all HVAC control modes of a particular HVAC unit from a controller for the particular HVAC unit;

receiving energy usage data for a plurality of load lines in an energy distribution panel, the plurality of load lines including a load line for the particular HVAC unit;

correlating the historical control mode data over a time period with the energy usage for the plurality of load lines over the time period wherein correlating comprises:

assigning a true/false status for each control mode of the HVAC unit;

assigning a true/false status for an energy usage of each of the plurality of load lines, wherein a true status corresponds to positive energy usage in an individual load line;

creating an array of statuses for each HVAC control mode;

comparing the true/false status for energy usage for each of the plurality of load lines with the true/false status for each control mode of the HVAC unit; and pairing the particular HVAC unit with the energy true/false status for a particular load line based on the correlation of the HVAC control modes for the particular HVAC unit with the energy usage for the particular load line;

matching normal patterns in energy usage with the use of any of the HVAC control modes;

identifying deviation from normal patterns;

identifying potential problems with the particular HVAC unit based on the deviations from normal patterns; and reporting identified problems to a user.

2. The method of claim 1 further comprising utilizing additional parameters of the particular HVAC unit with the energy usage and control mode to identify potential problems with the particular HVAC unit.

3. The method of claim 2 wherein the additional parameter is sensor air temperature.

4. The method of claim 1 further comprising reporting the potential problems to a remote server.

5. The method of claim 1 further comprising reporting the potential problems to a user.

6. The method of claim 1 wherein the particular HVAC unit is one of a plurality of HVAC units.

7. The method of claim 1 wherein the energy usage is collected by sensing current in a breaker panel associated with the particular HVAC unit.

8. A system for self-diagnosing heating, ventilation and air conditioning (HVAC) systems comprising:

a microcontroller;

an HVAC control module communicatively coupled to the microcontroller and operable to provide control signals to an HVAC unit and to record control modes for the HVAC unit;

an energy usage collection interface communicatively coupled to the microcontroller, the energy usage collection interface operable to receive energy usage data from a plurality of energy meters installed on a plurality of load lines at an electrical distribution panel;

wherein the microcontroller is operable to correlate all HVAC control modes from the HVAC control module with an energy usage over a time period for the plurality of load lines, wherein the correlating comprises;

assigning a true/false status for each control mode of the HVAC unit;

assigning a true/false status for an energy usage of each of the plurality of load lines, wherein a true status corresponds to positive energy usage in an individual load line;

creating an array of states for each HVAC control mode;

comparing the true/false status for energy usage for each of the plurality of load lines with the true/false status for each control mode of the HVAC unit; and pairing the particular HVAC unit with the energy true/false status for a particular load line based on the correlation of the HVAC control modes for the particular HVAC unit with the energy usage for the particular load line; and wherein the microcontroller is further operable to match normal patterns in energy usage for any of the HVAC control modes, thereby allowing the microcontroller to analyze current energy usage and HVAC control mode pairings against the normal patterns to identify potential problems with the HVAC unit based on deviations from normal patterns, and wherein the microcontroller is operable to report the potential problems to a user.

9. The system of claim 8 further comprising environmental sensors communicatively coupled to the microcontroller, the environmental sensors providing information to the microcontroller used in determining the operation of the HVAC system.

10. The system of claim 9 wherein the microcontroller is operable to utilize additional parameters of the HVAC unit collected from the environmental sensors with the energy usage and control mode to identify potential problems with the HVAC unit.

11. The system of claim 9 wherein the environmental sensors include a temperature sensor.

12. The system of claim 8 further comprising a communications interface to report the potential problems to a remote server.

13. The system of claim 8 wherein the particular HVAC unit is one of a plurality of HVAC units.

14. The system of claim 8 wherein the energy usage is collected by sensing current in a breaker panel associated with the particular HVAC unit.

* * * * *